US007993597B2

(12) United States Patent
Kinomoto et al.

(10) Patent No.: US 7,993,597 B2
(45) Date of Patent: Aug. 9, 2011

(54) CATALYST SUPPORT STRUCTURE

(75) Inventors: Naoki Kinomoto, Shizuoka-ken (JP); Susumu Yamazaki, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 965 days.

(21) Appl. No.: 11/837,411

(22) Filed: Aug. 10, 2007

(65) Prior Publication Data

US 2008/0089814 A1 Apr. 17, 2008

(30) Foreign Application Priority Data

Aug. 10, 2006 (JP) ..... 2006-218855

(51) Int. Cl.
*B01D 53/88* (2006.01)
*B01D 53/94* (2006.01)
*F01N 3/035* (2006.01)

(52) U.S. Cl. ..... 422/179; 440/89 H

(58) Field of Classification Search ..... 422/179, 422/180; 440/89 H; 60/299
See application file for complete search history.

(56) References Cited

U.S. PATENT DOCUMENTS 4,948,353 A * 8/1990 Maus et al. ..... 422/180
6,673,466 B2 * 1/2004 Bruck et al. ..... 422/180
7,241,427 B2 * 7/2007 Nagel et al. ..... 422/180
2003/0162451 A1 * 8/2003 Ozawa ..... 440/89 H

FOREIGN PATENT DOCUMENTS

JP 03-157139 7/1991

* cited by examiner

*Primary Examiner* — Jill Warden
*Assistant Examiner* — Joye L Woodard
(74) *Attorney, Agent, or Firm* — Keating & Bennett, LLP

(57) ABSTRACT

A catalyst for purifying an exhaust gas can include a carrier having a honeycomb structure, an outer pipe for covering a part of the carrier, and a brazing foil for joining the outer peripheral surface of the carrier and the inner peripheral surface of the outer pipe on the downstream side of the catalyst. The catalyst can be fixed to a support flange such that an axial direction of the catalyst coincides with the direction in which an exhaust gas flows through an exhaust pipe. An upstream end of the brazing foil can be aligned with the upstream end of a catalyst fixing part of the support flange. An upstream end of the catalyst fixing part can be positioned upstream of the axial middle of the carrier. The brazing foil can be provided in a portion from the upstream end of the catalyst fixing part to the downstream side of the carrier. The catalyst can be supported at its generally middle part by the support flange. An upstream end of the outer pipe can be aligned with the upstream end of the catalyst fixing part.

5 Claims, 13 Drawing Sheets

CATALYST SUPPORT STRUCTURE

PRIORITY INFORMATION

This application is based on and claims priority to Japanese Patent Application No. 2006-218855, filed Aug. 10, 2006, the entire contents of which is hereby expressly incorporated by reference.

BACKGROUND OF THE INVENTIONS

1. Field of the Inventions

The preset inventions relate to exhausts systems, and more particularly, to a catalyst support structure for supporting a catalyst installed in an exhaust pipe.

2. Description of the Related Art

Conventional engines of small watercrafts, such as personal watercraft and other vehicles typically include exhaust pipes for guiding exhaust gasses to the atmosphere. Some of the exhaust systems of these vehicles include a catalyst for purifying the exhaust gas before it is discharged into the atmosphere.

For example, Japanese Patent Document JP-A-Hei 3-157139 discloses a catalyst (metal carrier for exhaust gas purification) formed by a honeycomb structure wound into a roll with an outer pipe around the honeycomb structure and an intermediate pipe between the honeycomb structure and the outer pipe. The honeycomb structure and the outer pipe are assembled together via the intermediate pipe. First, the inner peripheral surface at one end of the intermediate pipe and the outer peripheral surface of the honeycomb structure are brazed together. Then, the outer peripheral surface at the other end of the intermediate pipe and the inner peripheral surface of the outer pipe are brazed together.

SUMMARY OF THE INVENTIONS

An aspect of at least one of the embodiments disclosed herein includes the realization that the cost and complexity of the catalyst assembly disclosed in Japanese Patent Document JP-A-Hei 3-157139 can be reduced. For example, in the catalyst device of Japanese Patent Document JP-A-Hei 3-157139 the honeycomb structure and the outer pipe are assembled together via an intermediate pipe. This results in a high parts count and requires multiple brazing steps. As a result, the man-hours required for assembly and total cost are unnecessarily high. In addition, the connecting part between the honeycomb structure and the intermediate pipe and the connecting part between the intermediate pipe and the outer pipe are away from each other on opposite sides of the catalyst. Accordingly, the honeycomb structure is supported at its one end by the outer pipe via the intermediate pipe, in a cantilevered fashion. Thus, if a significant impact is applied to the catalyst for example, a breakage may occur between the honeycomb structure and the intermediate pipe or between the intermediate pipe and the outer pipe.

Thus, in accordance with an embodiment, a catalyst support can comprise an exhaust pipe for an engine, a support flange, and a catalyst supported in the exhaust pipe with the support flange. The catalyst can be configured to purify exhaust gas passing through the exhaust pipe and can comprise a carrier including a flat plate and a corrugated plate layered together. The flat and corrugated plates can be rolled up together in a generally columnar shape so that the carrier has a honeycomb structure. An outer pipe can be configured to cover circumferentially a first part of an outer peripheral surface of the carrier. A brazing foil can join the first part of the outer peripheral surface of the carrier and a first part of an inner peripheral surface of the outer pipe. The catalyst can be fixed to the support flange such that an axial direction of the catalyst coincides with the direction in which the exhaust gas flows through the exhaust pipe. Additionally, an end of the brazing foil on the upstream side of the exhaust pipe can be aligned axially with an end of the support flange and the support flange can contact the catalyst on the upstream side of the exhaust pipe.

In accordance with another embodiment, a catalyst device can comprise an exhaust pipe for an engine, a support flange, and a catalyst assembly supported in the exhaust pipe with the support flange. The catalyst assembly can comprise a carrier, an outer pipe covering a first part of an outer peripheral surface of the carrier, and a brazing foil joining the first part of the outer peripheral surface of the carrier and a first part of an inner peripheral surface of the outer pipe. Additionally, an end of the brazing foil on the upstream side of the exhaust pipe can be aligned axially with an upstream end of the support flange, the upstream end of the support flange being disposed rearwardly from the upstream end of the carrier.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures.

DETAILED DESCRIPTION OF THE PREFERRED EMBODIMENTS

Improved exhaust systems for an engine are disclosed herein. Although the present exhaust systems are illustrated and described in the context of an engine of a personal watercraft, certain aspects of the present inventions can be used with engines of other types of vehicles, as well as with other types of prime movers.

Figure 1:
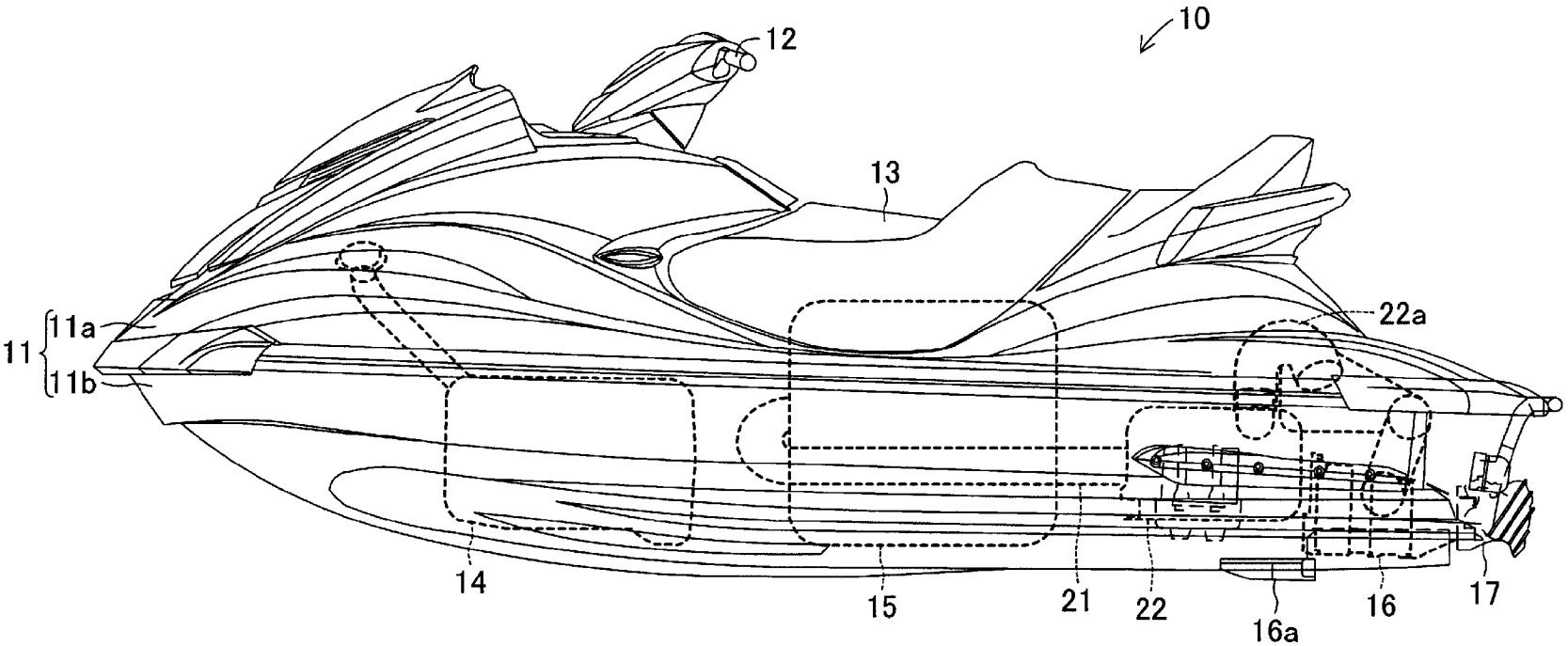
FIG. 1 is a schematic side elevational view of a watercraft having an engine and a catalyst support structure in accordance with an embodiment.

FIG. 1 illustrates a water vehicle 10 having a catalyst support structure A (see FIG. 4) in accordance with an embodiment. The water vehicle 10 can have a body 11 including a deck 11*a* and a hull 11*b*. The body 11 can have steering handlebars 12 disposed on the upper part of the body 11 and slightly in front of its center.

A seat 13 can be disposed centrally of the upper part of the body 11. A fuel tank 14 for holding fuel therein can be disposed at the front bottom inside the body 11. An engine 15 can be disposed at the center bottom inside the body 11.

A propulsion unit 16 can be disposed centrally in the width direction of the body 11 at the rear end of the body 11. The propulsion unit 16 can be coupled to the engine 15 via an impeller shaft (not shown).

A steering nozzle 17 can be attached to the rear end of the propulsion unit 16. The steering nozzle 17 can be selectively pivoted such that it rear end moves left or right in response to driver's operation of the steering handlebars 12 to thereby change the running direction of the water vehicle 10 toward the left or right.

Figure 2:
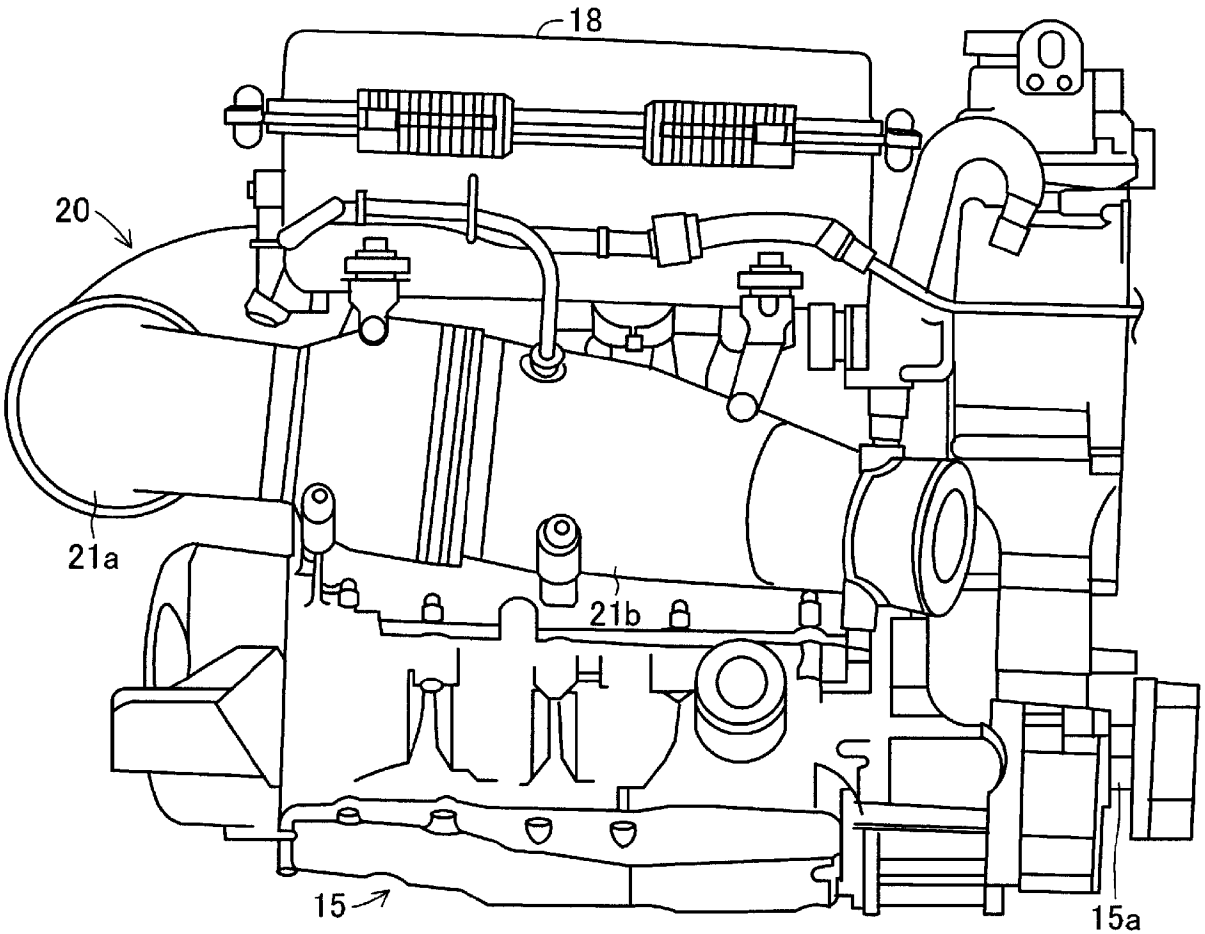
FIG. 2 is a side view of the engine and exhaust system of the water vehicle shown in FIG. 1.

As shown in FIG. 2, the engine 15 can be connected to an intake system 18 configured to deliver a mixture of fuel fed from the fuel tank 14 and air to the engine 15. An exhaust system 20 can be configured to guide exhaust gas from the engine 15 to the outside from the rear end of the body 11.

The engine 15 can be a four-stroke, four-cylinder engine. However, this is merely one type of engine that can be used. Those skilled in the art readily appreciate that the present exhaust systems and catalyst-related components can be used with any of a variety of engines having other numbers of cylinders, and/or other cylinder arrangements, and/or operating on other principles of operation (diesel, 2-stroke, rotary, etc.).

Each cylinder can be provided with an intake valve and an exhaust valve. The intake and exhaust valves can be selectively opened and closed to allow a mixture of fuel and air can to flow into the engine 15 from the intake system 18 on the intake valve side. Exhaust gases can be delivered to the exhaust system 20 on the exhaust valve side.

During operation, the mixture supplied into the engine 15 from the intake valve side explodes as it is ignited by an ignition device of the engine 15. The explosion moves a piston in each cylinder of the engine 15 vertically. The movement of the pistons causes a crankshaft 15*a* to rotate. The crankshaft 15*a* can be coupled to the impeller shaft, and thus can transmit its rotational force to the impeller shaft to rotate it. The impeller shaft can be formed of a single shaft, or a plurality of shafts connected together with, for example, splined shaft connections.

The rear end of the impeller shaft can be coupled to an impeller disposed in the propulsion unit 16. The rotation of the impeller generates a propulsive force of the water vehicle 10.

For example, the propulsion unit 16 can have a water inlet 16*a* that can be open at the bottom of the body 11 and a water outlet, e.g., a discharge nozzle (not shown), that can be open at the stern. When seawater is introduced through the water inlet 16*a* of the body 11 and then spouted by the rotation of the impeller through the water outlet, a propulsive force is imparted to the body 11.

The intake system 18 can include intake pipes connected to the engine 15, throttle bodies connected to the upstream ends of the intake pipes, and other components. The intake system 18 can be configured to guide outside air in a water vehicle, and adjust the flow rate of the air by selectively opening and closing a throttle valve provided in the throttle body, to feed the air to the engine 15. However, other types of systems can be used with more or fewer throttle valves, including systems with no throttle valve at all. Such throttle-less systems can use variable valve timing to meter induction air into the engine 15. Regardless of the type of intake system used, during operation, the air fed to the engine 15 can be mixed with fuel fed from the fuel tank 14 via a fuel system.

Figure 3:
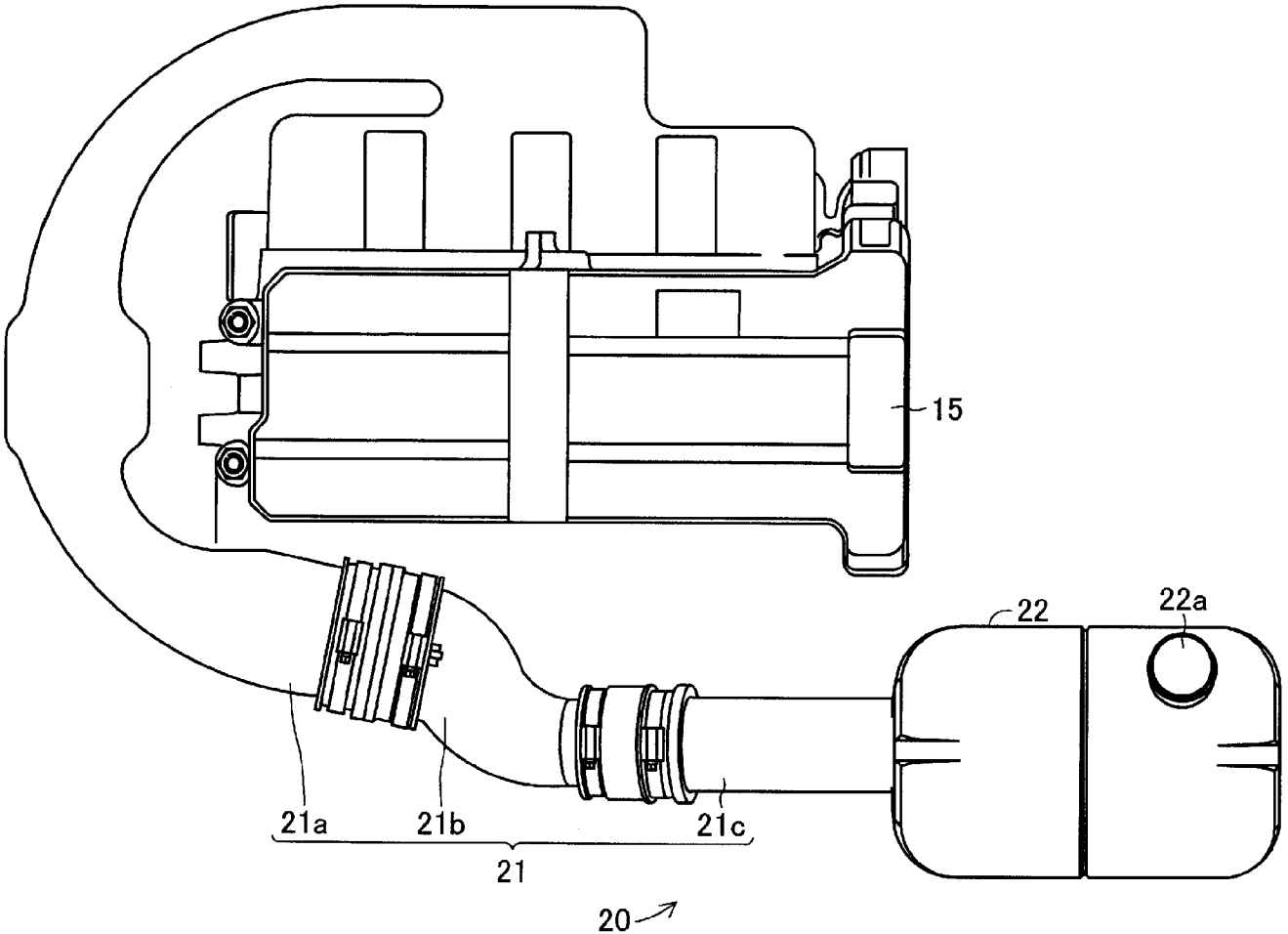
FIG. 3 is a schematic plan view of the exhaust system of the engine of the water vehicle shown in FIG. 1.

As shown in FIG. 2 and FIG. 3, the exhaust system 20 can include an exhaust pipe 21 formed of a pipe having various radii of curvature and connected to the engine 15, a tank-like water lock 22 connected to the rear end of the exhaust pipe 21, a discharge pipe 22*a* connected to the rear part of the water lock 23, and/or other components. Exhaust pipes 21 extending from the exhaust valves of the respective cylinders of the engine 15 can be joined together at one point on the starboard side of the body 11, and further extend forward. However, other configurations can also be used.

The extended end of the exhaust pipe 21 can extend toward the portside of the body 11 to surround or partially wrap around the front of the engine 15 and can further extend rearwardly passing across the side of the engine 15. The rear end of the exhaust pipe 21 can communicate with the front part of the water lock 22.

The discharge pipe 22*a* (FIG. 1) can extend further rearward from a rear upper surface of the water lock 22. The discharge pipe 22*a* can extend upwardly form the rear upper surface of the water lock 22 and further downwardly and rearwardly. The downstream end of the discharge pipe 22*a* can communicate with the lower rear part of the body 11. For example, the downstream end of the discharge pipe 22*a* can be connected to a through-the-hull fitting such that exhaust gases can be discharged from the body 11 at a position below the waterline when, for example, the watercraft 10 is at idle and floating in the water. However, other configurations can also be used.

The exhaust pipe 21 can comprise the upstream pipe 21*a*, disposed closer to the engine 15, which can be referred to as a "first exhaust pipe", a downstream pipe 21*b*, connected to the downstream end of the upstream pipe 21*a*, which can be referred to as a "second exhaust pipe", and a connecting pipe 21*c* connecting the downstream pipe 21*b* and the water lock 22.

Figure 4:
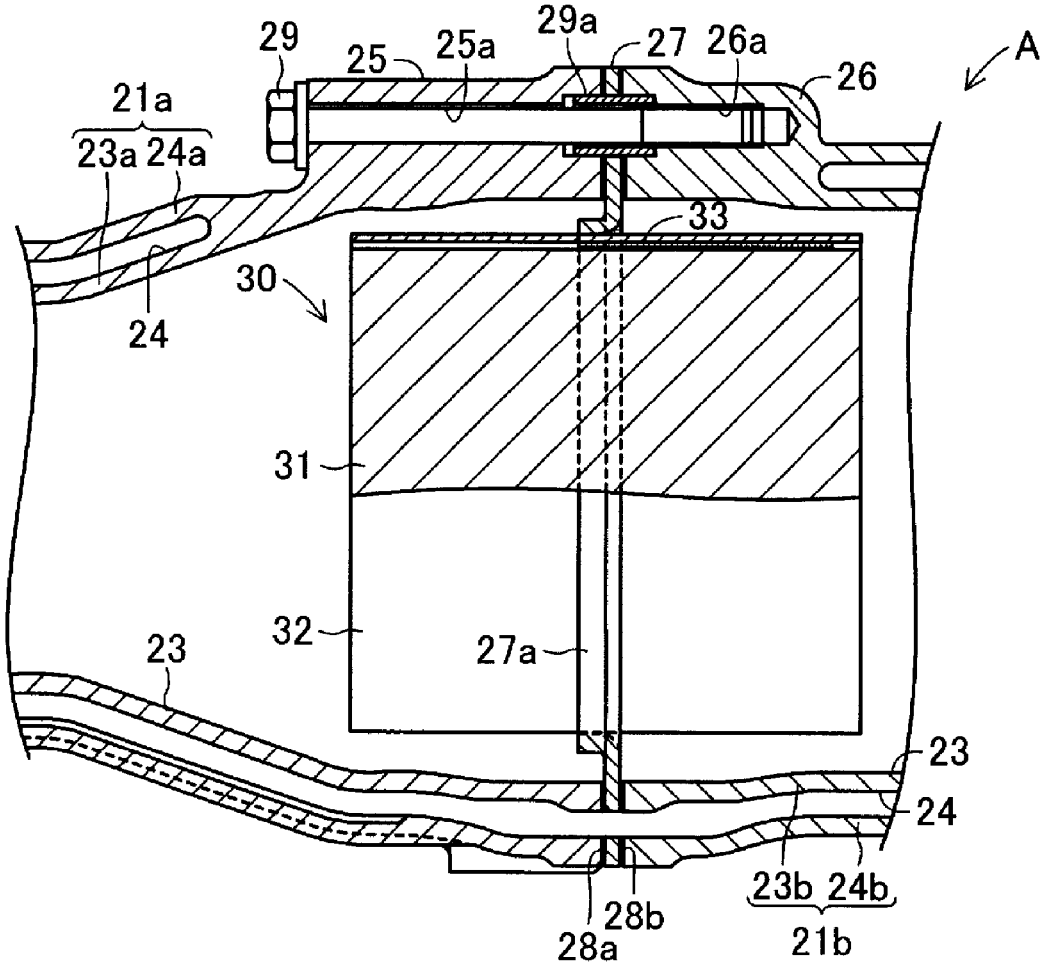
FIG. 4 is a cross-sectional view of the catalyst support structure.

As shown in FIG. 4, the upstream pipe 21*a* can comprise a double-pipe structure including an inner pipe 23*a* and an outer pipe 24*a*. The downstream pipe 21*b* can also comprise a double-pipe structure including an inner pipe 23*b* and an outer pipe 24*b*.

The inner pipes 23*a*, 23*b* can each define an exhaust gas passage 23 therein through which an exhaust gas from the engine 15 passes. The outer peripheral surface of the inner pipe 23*a* and the inner peripheral surface of the outer pipe 24*a* can define a first cooling water passage 24 therebetween. Additionally, the outer peripheral surface of the inner pipe 23*b* and the inner peripheral surface of the outer pipe 24*b* define a second cooling water passage 24 therebetween. The first and second cooling water passages 24 can communicate with each other and thus allow the cooling water that cooled the engine 15 and other parts to pass therethrough.

The cooling water passing through the cooling water passages 24 can be sea water, for example, taken in through the rear bottom of the body 11. This cooling water passes through various cooling water passages (not shown) provided in the body 11 to cool various parts of the engine 15 and/or other parts. The cooling water can pass through the cooling water passages 24 to cool the upstream pipe 21*a* and the downstream pipe 21*b*, and then can join with an exhaust gas in the connecting pipe 21*c* to be mixed with and discharged to the outside along with the exhaust gases.

With continued reference to FIG. 4, the downstream end of the upstream pipe 21*a* can have five (only one is shown) threaded hole parts 25 spaced apart circumferentially from each other. However, other numbers of hole parts 25 and patterns can also be used. In some embodiments, the material forming the threaded hole parts 25 can divide or block part of the first cooling water passage 24.

The threaded hole part 25 can have a threaded hole 25*a* extending therethrough from the upstream end face to the downstream side of the threaded hole part 25. Like the downstream end of the upstream pipe 21*a*, the upstream end of the downstream pipe 21*b* also can have five (only one is shown) threaded hole parts 26 spaced apart circumferentially from each other. However, other numbers of hole parts 26 and patterns can also be used. As noted above with regard to the threaded hole parts 25, in some embodiments, the material forming the threaded hole parts 26 can divide or block part of the first cooling water passage 24. The threaded hole part 26 can have a threaded hole 26*a* extending from the upstream end face to the downstream side of the threaded hole part 26.

Between the downstream end face of the upstream pipe 21*a* and the upstream end face of the downstream pipe 21*b*, a support flange 27 can be provided. The support flange 27 can be configured to support a catalyst 30. In some embodiments, the support flange 27 can be disposed with its both sides sandwiched between a pair of metal gaskets 28*a*, 28*b*.

Figure 5:
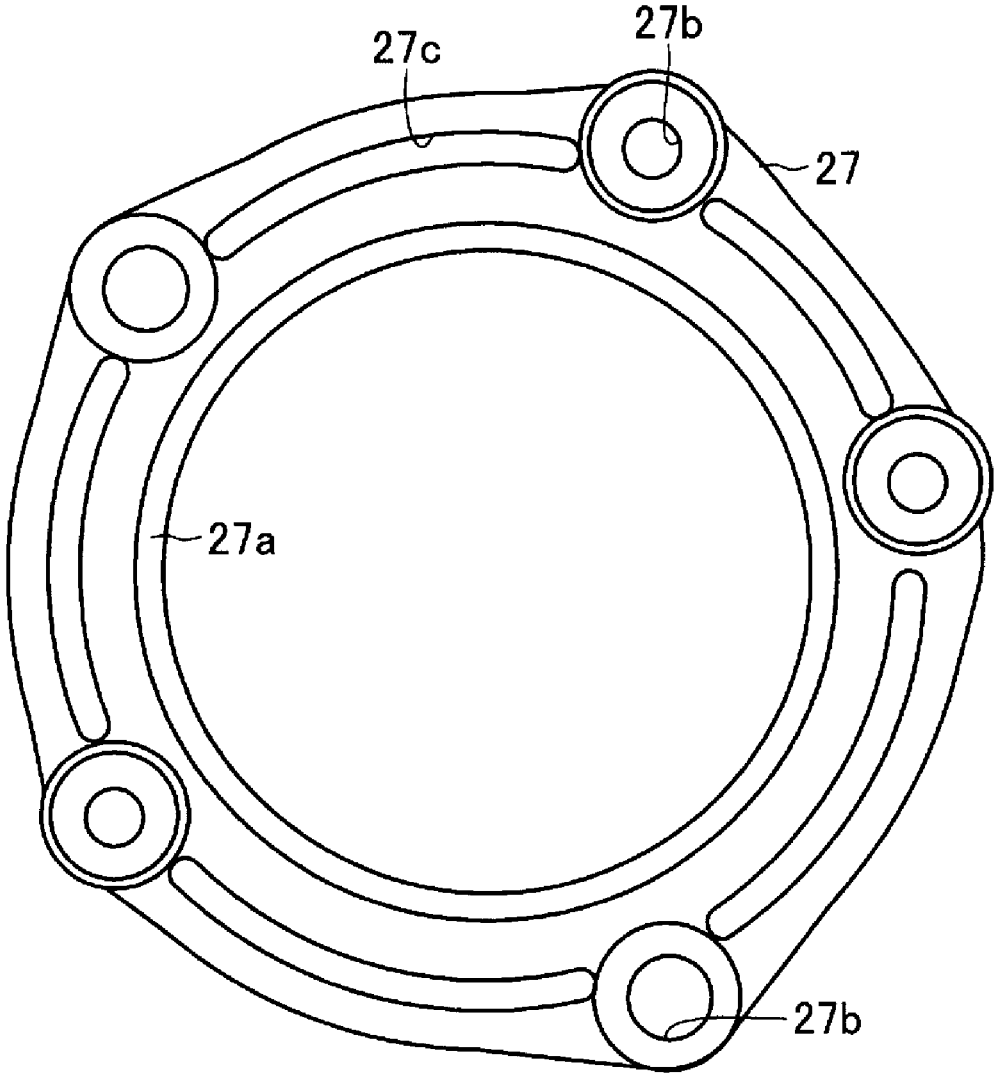
FIG. 5 is a front view of a support flange of the catalyst support structure.
Figure 6:
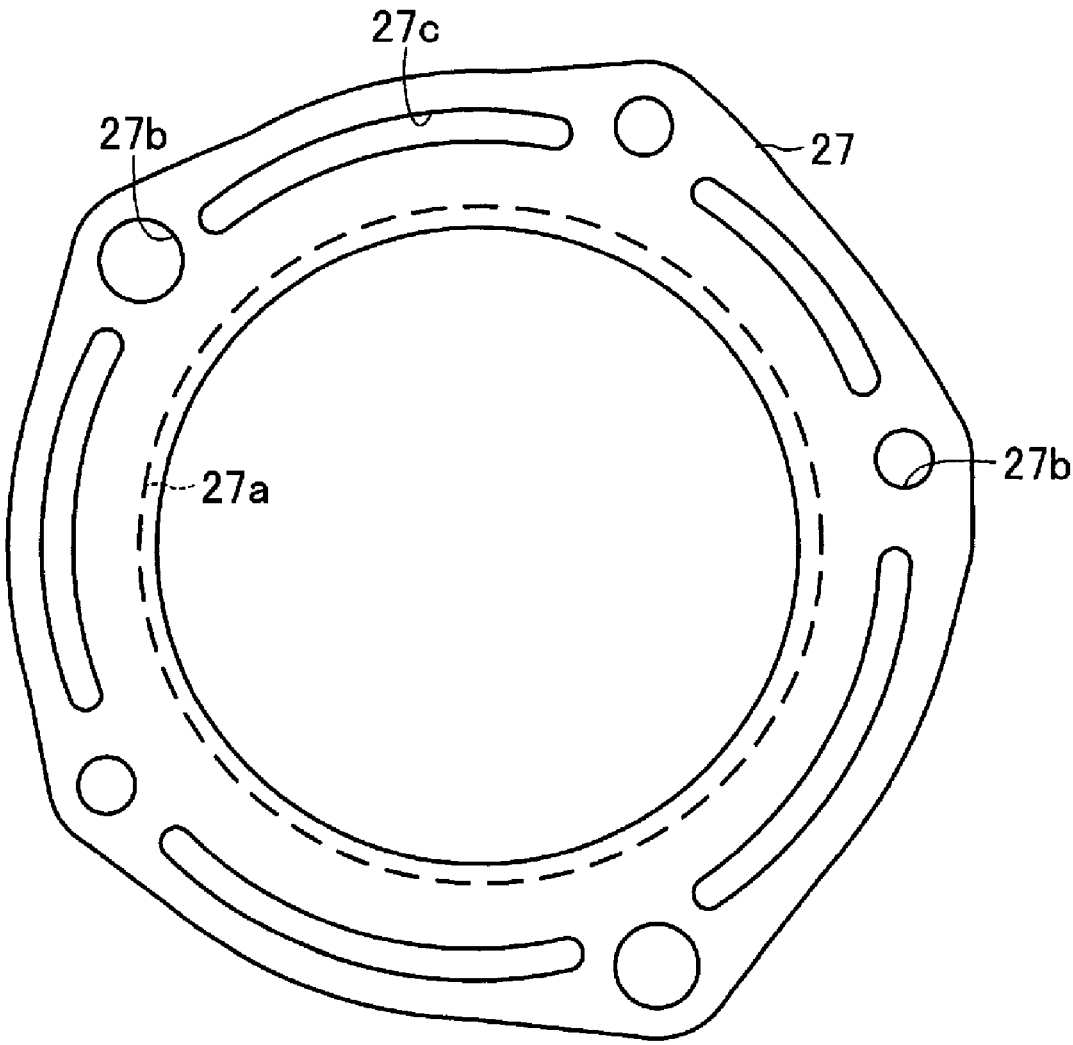
FIG. 6 is a rear view of the support flange shown in FIG. 5.
Figure 7:
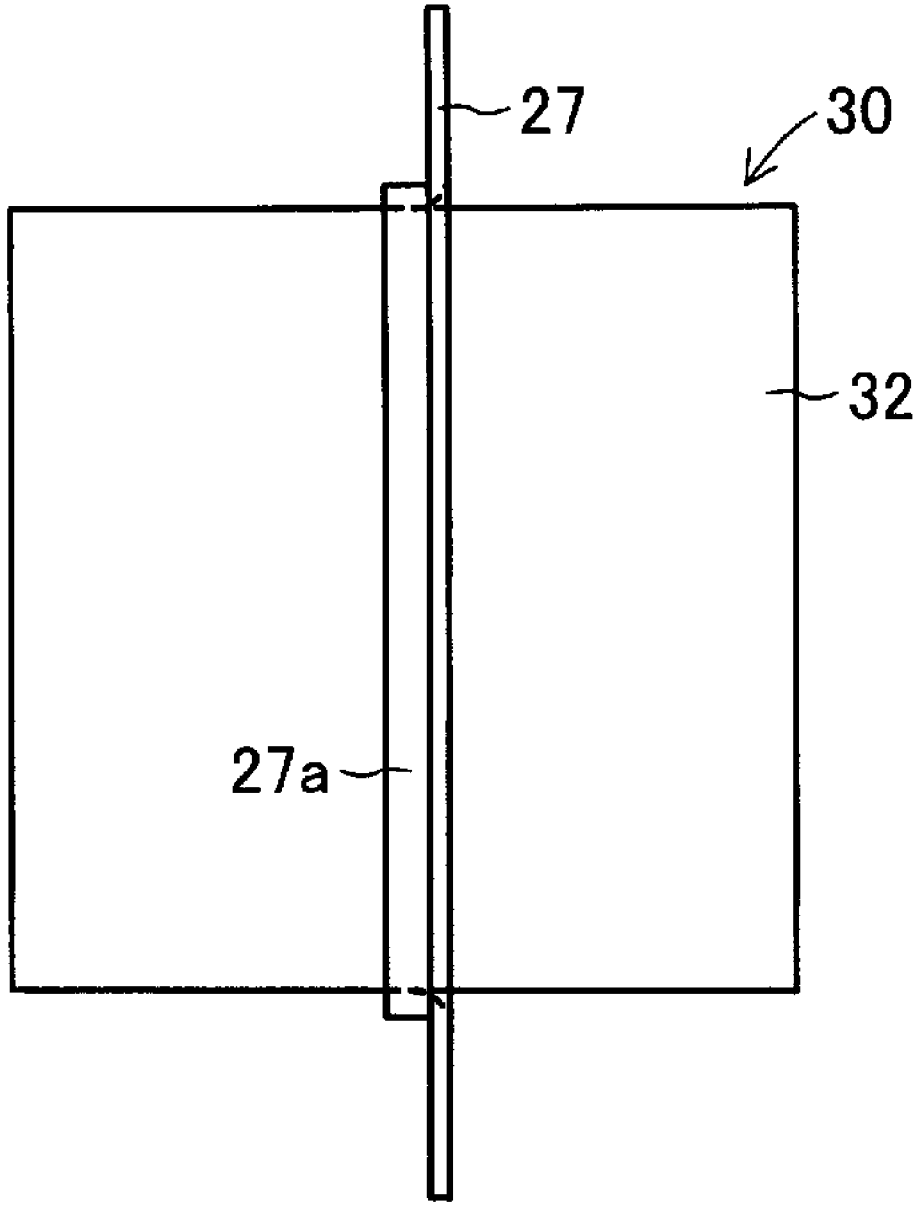
FIG. 7 is a side view illustrating the state where a catalyst is mounted on the support flange shown in FIG. 5.

As shown in FIGS. 5 to 7, the support flange 27 can be formed of a generally circular plate which has is central part removed, thereby forming generally ring or annular shape. The generally ring-shaped plate can have a relatively short, tubular, catalyst fixing part 27*a* projecting from the inner peripheral edge thereof toward one side thereof.

The support flange 27 can be configured to mate with the end face of the upstream pipe 21*a* and the upstream end face of the downstream pipe 21*b*. For example, the support flange 27 can have five screw holes 27*b* formed therethrough at the outer peripheral end which can be spaced apart circumferentially from each other. Between each of the adjacent screw holes 27*b*, an arcuate cooling water passage slit 27*c* can be formed along a generally circumferential path.

For example, the outer peripheral end of one side of the support flange 27 having the catalyst fixing part 27*a* can be shaped so as to correspond to the downstream end of the upstream pipe 21*a* when facing it. The outer peripheral end of the other side of the support flange 27 can be shaped so as to correspond to the upstream end face of the downstream pipe 21*b* when facing it.

The metal gaskets 28*a*, 28*b* can also have the same shapes respectively as the downstream end face of the upstream pipe 21*a* and the upstream end face of the downstream pipe 21*b*. The support flange 27 with the metal gaskets 28*a*, 28*b* respectively in contact with both sides of the support flange 27 can be disposed between the downstream end face of the upstream pipe 21*a* and the upstream end face of the downstream pipe 21*b*. Bolts 29 can be inserted through the threaded holes 25*a*, the screw holes 27*b*, the threaded holes 26*a* and the like to connect the upstream pipe 21*a* and the downstream pipe 21*b*.

With continued reference to FIG. 4, a part where the threaded hole 25*a* and the threaded hole 26*a* face each other, can have a hole of a slightly larger diameter. In the larger-diameter hole, a tubular dowel pin 29*a* can be attached through which the bolt 29 can pass.

Since a connecting part between the upstream pipe 21*a* and the downstream pipe 21*b* are structured in a manner described above, the first cooling water passage 24 of the upstream pipe 21*a* and the second cooling water passage 24 of the downstream pipe 21*b* communicate with each other through the cooling water passage slits 27*c* and the like of the support flange 27 and the metal gaskets 28*a*, 28*b*. As a result, the cooling water passing though the first cooling water passage 24 of the upstream pipe 21*a* flows into the second cooling water passage 24 of the downstream pipe 21*b* through five parts with openings, where the threaded hole parts 25 are not formed, at the downstream end of the first cooling water passage 24 and through the cooling water passage slits 27*c* and the like.

Figure 8:
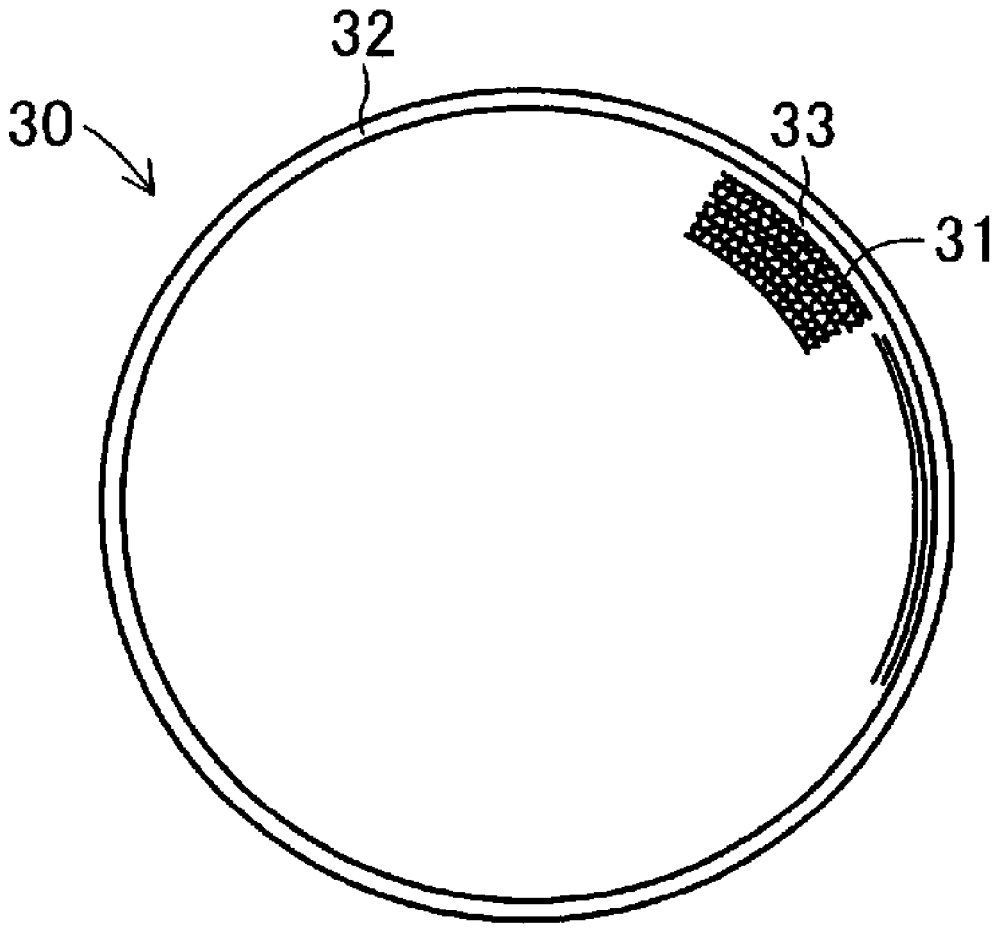
FIG. 8 is a front view of the catalyst shown in FIG. 7.
Figure 9:
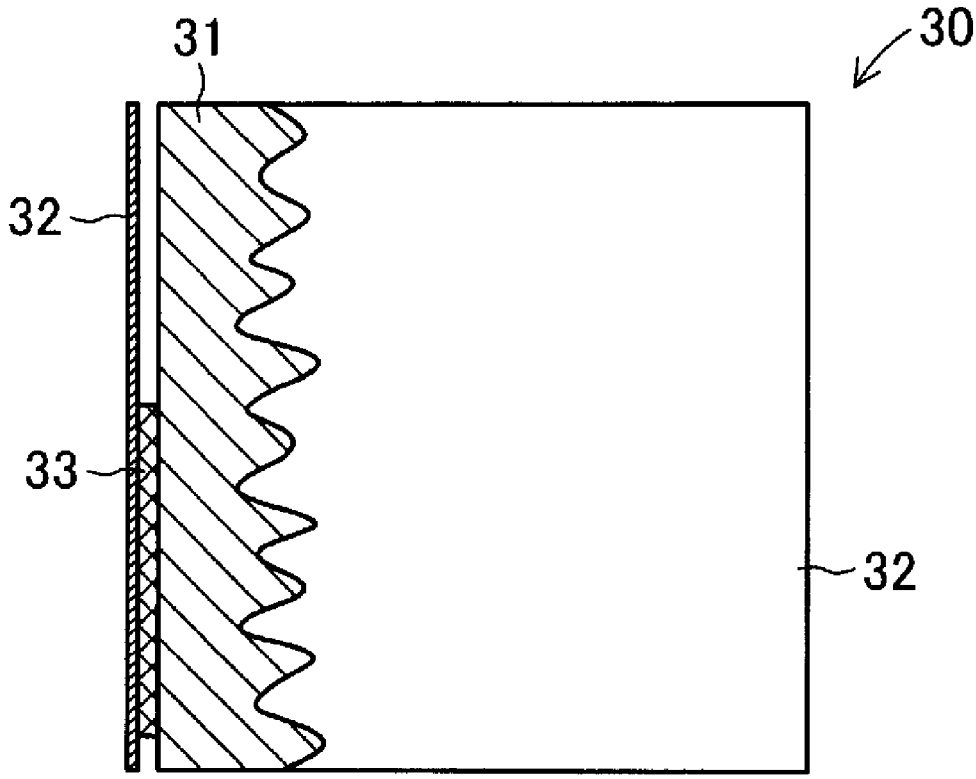
FIG. 9 is a partial cutaway cross-sectional view of the catalyst shown in FIG. 7.
Figure 10:
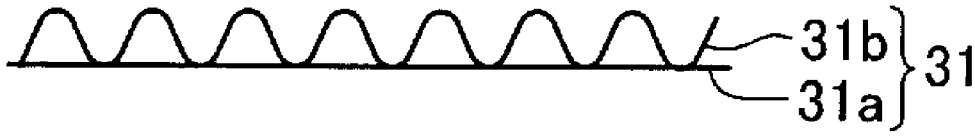
FIG. 10 is a front view illustrating the state where a flat plate and a corrugated plate forming a carrier together are assembled.

As shown in FIGS. 8 and 9, the catalyst 30 can include a generally columnar carrier 31, an outer pipe 32 for covering the outer periphery of the carrier 31, and a brazing foil 33 for joining the carrier 31 and the outer pipe 32. The carrier 31 can be formed in a columnar shape with any known method. One exemplary but non-limiting method can comprise, with reference to FIG. 10, layering together a flat plate 31*a* and a corrugated plate 31*b* both formed of a thin, stainless-steel plate, and then brazing them together at their contacting parts. This plate assembly can then be rolled up so that the direction in which the convex and concave parts of the corrugated plate 31*b* extend, coincides with the axial direction of the plate assembly. For this reason, the carrier 31 can be of a honeycomb structure and can have a plurality of axial through-holes. The carrier 31 can include on the surface thereof a layer of precious metal such as a platinum-rhodium alloy.

The outer pipe 32 has the same axial length as the carrier 31. The outer pipe 32 can be formed of a stainless-steel, relatively thin-walled pipe, and can have an inside diameter slightly larger than the outside diameter of the carrier 31. The outer peripheral surface of the carrier 31 can be fixed to the inner peripheral surface of the outer pipe 32, with the brazing foil 33, in an area from a part closer to one end of the carrier 31 slightly beyond its axial middle to the vicinity of the other end. The outer pipe 32 and the catalyst fixing part 27*a* can be fixedly welded together at a certain part, with the distal end of the catalyst fixing part 27*a* aligned with one end of the brazing foil 33 on the outer peripheral surface of the outer pipe 32. However, other configurations can also be used.

Using the above or other configurations, the catalyst 30 can be mounted within a central opening of the support flange 27. In this case, the proximal end of the catalyst fixing part 27*a* of the support flange 27 (corner where a body of the support flange 27 and the catalyst fixing part 27*a* meet) can be positioned at a generally middle part in the axial direction of the catalyst 30.

The support flange 27 can be fixed between the downstream end of the upstream pipe 21*a* and the upstream end of the downstream pipe 21*b*. In this case, one end of the catalyst fixing part 27*a* closer to where the carrier 31 and the outer pipe 32 are fixed together with the brazing foil 33 (corner where the body of the support flange 27 and the catalyst fixing part 27*a* meet) can be positioned more downstream than the other end (distal end of the catalyst fixing part 27*a*) in the exhaust gas passage 23.

During operation, the driver can turn on a start switch (not shown). This puts the water vehicle 10 in a state ready for operation. As the driver straddling the seat 13 operates the steering handlebars 12 and a throttle lever (not shown), the water vehicle 10 moves at a certain speed in a certain direction in response to the driver's operations.

Exhaust gas from the engine 15 flows into the catalyst 30 through the exhaust gas passage 23 of the upstream pipe 21*a*. While passing through the catalyst 30, the exhaust gas is purified as harmful gases contained in the exhaust gas reacts with a catalyst layer on the surface of the honeycomb structure of the carrier 31. For example, this reaction can comprise an oxidation of unburned hydrocarbons in the exhaust gas. The purified exhaust gas flows into the connecting pipe 21*c* through the exhaust gas passage 23 of the downstream pipe 21*b*. Additionally, cooling water flowing from the engine 15 side after cooling the engine 15 and other parts flows into the connecting pipe 21*c* through the cooling water passages 24 of the upstream pipe 21*a* and the downstream pipe 21*b*.

The cooling water cools the upstream pipe 21*a* and the downstream pipe 21*b*, and then can be sprayed into the connecting pipe 21*c* in the form of generally atomized water droplets of relatively small size. In the connecting pipe 21*c*, the exhaust gas flowing through the exhaust gas passages 23 and the cooling water flowing through the cooling water passages 24 mix together.

The mixture of the exhaust gas and the cooling water flows from the connecting pipe 21*c* into the water lock 22, and then flows from the water lock 22 through the discharge pipe 22*a* to the outside. The discharge pipe 22*a* and the water lock 22 can be configured to prevent water from flowing back and entering the exhaust pipe 21.

As described above, with a catalyst support structure A, an exhaust pipe 21 can comprise an upstream pipe 21*a* and a downstream pipe 21*b*, each pipe including an exhaust gas passage 23 through which an exhaust gas passes, and a cooling water passage 24 around the exhaust gas passage 23. A support flange 27 with a cooling water passage slit 27*c* can be provided at a connecting part between the upstream pipe 21*a* and the downstream pipe 21*b* such that the cooling water passage 24 of the upstream pipe 21*a* and the cooling water passage 24 of the downstream pipe 21*b* communicate with each other through the cooling water passage slit 27*c*. The catalyst 30 can be mounted within a central opening of the support flange 27.

As a result, the cooling water passing through the cooling water passage slit 27*c* and thereby thermally communicates with the support flange 27, which in turn cools the support flange and the catalyst 30. This minimizes a change in temperature of the surfaces of the brazing foil 33 and the carrier 31 of the catalyst 30, which suppresses expansion or contraction of a connecting part between the brazing foil 33 and the carrier 31. Accordingly, less damage occurs to the connecting part between the brazing foil 33 and the carrier 31 due to thermal fatigue, and thus the catalyst 30 can be more reliably fixed to the support flange 27.

A generally middle part in the axial direction of the catalyst 30 can be supported by the support flange 27, and the upstream end of the brazing foil 33 joining the carrier 31 and the outer pipe 32 can be aligned with the upstream end of the catalyst fixing part 27*a* of the support flange 27 as shown in FIG. 4, such that no portion of the brazing foil 33 is upstream from the upstream end of the support flange 27. As a result, the catalyst 30 can be supported in a more balanced manner.

In addition, although the upstream end of a connecting part between the catalyst 30 and the support flange 27 tends to expand or contract due to heat, it can be securely fixed. Further, even when the upstream end of the connecting part between the catalyst 30 and the support flange 27 undergoes an intensive stress, the catalyst 30 can be less likely to come off the support flange 27.

The carrier 31 and the outer pipe 32 can be fixed directly to each other via the brazing foil 33. This provides a lower parts count and fewer fixing parts with the brazing foils 33. This reduces the man-hour needed for assembly and provides a lower cost. Further, since a gap can be defined between the upstream side of the carrier 31 and the upstream side of the outer pipe 32, expansion or contraction of the upstream side of the carrier 31 will not interfere with the outer pipe 32. Accordingly, any expansion or contraction of the carrier 31 due to a change in temperature results in less damage to the carrier 31. Further, since the carrier 31 and the outer pipe 32 are composed of stainless steel, they have excellent corrosion resistance to an exhaust gas as well as excellent heat cycle resistance, and thus have a longer service life.

Figure 11:
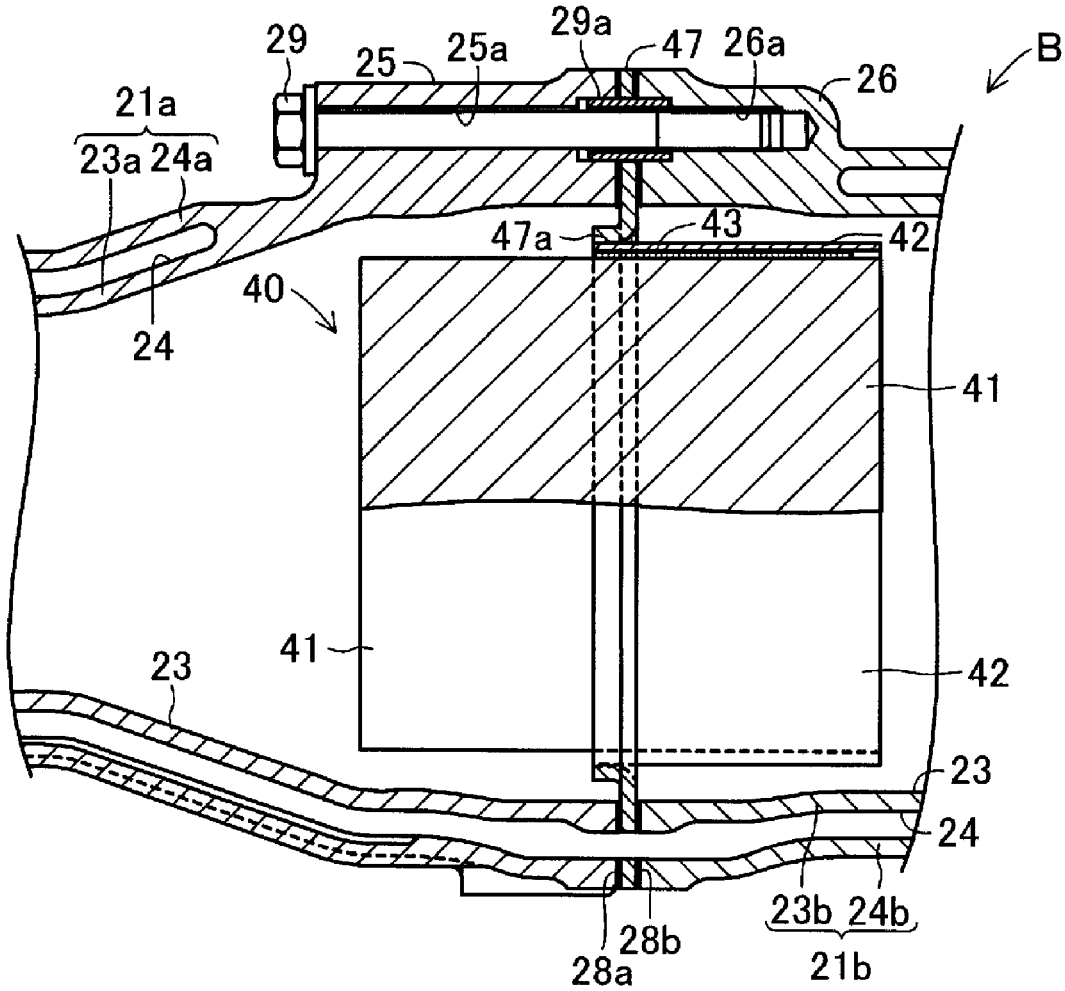
FIG. 11 is a cross-sectional view of a modification of the catalyst support structure.

FIG. 11 illustrates a modification of the catalyst support structure A, and is generally identified by the reference letter "B". In this catalyst support structure B, a carrier 41 of a catalyst 40 can be of the same type as the carrier 31 described above.

As shown in FIG. 11, an outer pipe 42 can be formed by a pipe that is shorter than the carrier 41. In such embodiments, the upstream end of the outer pipe 42 can be positioned slightly upstream of the axial middle of the carrier 41, and the downstream end of the outer pipe 42 can be positioned at the downstream end of the carrier 41. A brazing foil 43 can be disposed such that its upstream end can be aligned with the upstream end of the outer pipe 42 and the upstream end of a catalyst fixing part 47*a* of a support flange 47, and its downstream end can be positioned slightly upstream of the downstream end of the carrier 41 and the downstream end of the outer pipe 42. The other parts of the catalyst support structure B which are not described above can be the same or similar to those of the catalyst support structure A described above. It is thus understood that similar components are identified with the same reference numerals and descriptions of those components are not repeated below.

With the above structure, the brazing foil 43 and the outer pipe 42 are not provided on the upstream side of the carrier 41 where it may be more intensely heated by direct exposure to the downstream flow of high temperature exhaust gas, thereby undergoing significant expansion or contraction. Therefore, the expansion or contraction of the carrier 41 can be prevented from being restrained by the brazing foil 13 or the outer pipe 42, and thus mechanical pressure applied to the carrier 41 can be reduced or eliminated. Accordingly, any expansion or contraction of the carrier 41 due to a change in temperature results in less damage to the carrier 41. The operation and effect of the catalyst support structure B which are not described above are similar to those of the catalyst support structure A of the first embodiment of the present invention.

Figure 12:
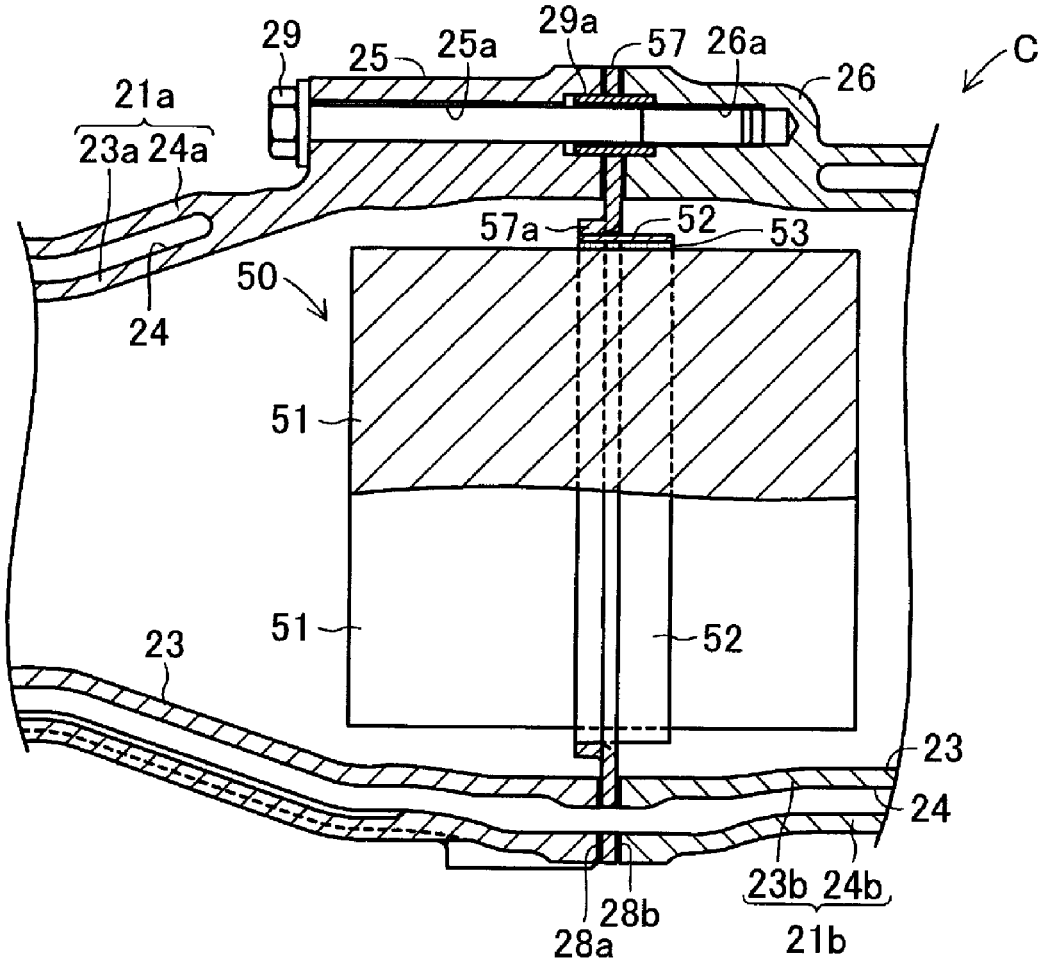
FIG. 12 is a cross-sectional view of another modification of the catalyst support structure.

FIG. 12 illustrates yet another modification of catalyst support structure A, identified generally by the reference letter "C". In this catalyst support structure C, a carrier 51 of a catalyst 50 can be of the same type as the carriers 31, 41 described above.

An outer pipe 52 can be formed by an even shorter pipe (ring). The upstream end of the outer pipe 52 can be positioned slightly upstream of the axial middle of the carrier 51, and the downstream end of the outer pipe 52 can be positioned slightly downstream of the axial middle of the carrier 51. A brazing foil 53 can be disposed such that its upstream end can be aligned with the upstream end of the outer pipe 52 and the upstream end of a catalyst fixing part 57*a* of a support flange 57, and its downstream end can be aligned with the downstream end of the outer pipe 52.

The other parts of the catalyst support structure C which are not described below can be the same or similar to those of the catalyst support structure A described above. It is thus understood that the descriptions of those similar components identified with the same reference are not repeated below.

Figure 13:
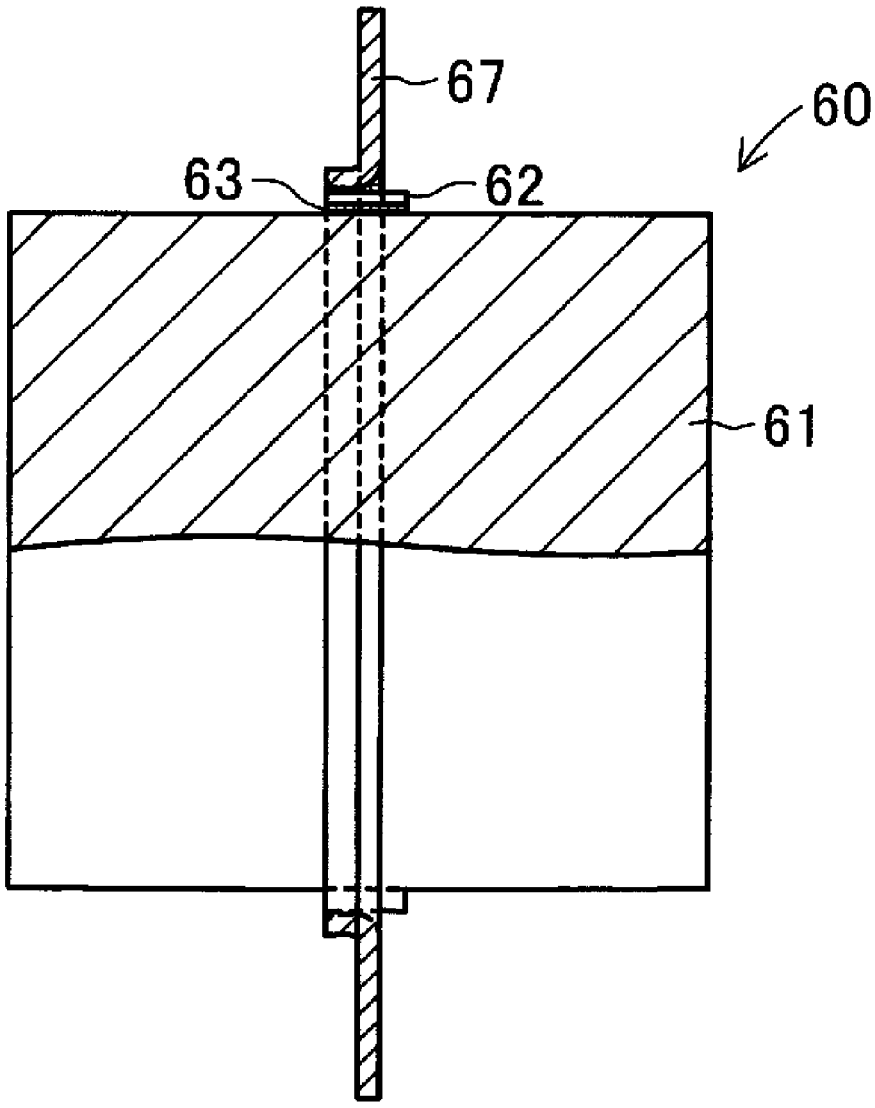
FIG. 13 is a partial cutaway cross-sectional view of a catalyst partially cut away and a support flange of a catalyst support structure in accordance with yet another modification.

With continued reference to FIGS. 12 and 13, the above structure, the brazing foil 53 and the outer pipe 52 are not provided on the downstream side of the carrier 51 as well as on the upstream side. Therefore, expansion or contraction of the carrier 51 can be prevented from being restrained by the brazing foil 53 or the outer pipe 52, and thus less mechanical pressure is applied to the carrier 51. Accordingly, any expansion or contraction of the entire carrier 51 due to a change in temperature results in less damage to the carrier 51. The operation and effect of the catalyst support structure C which are not described above are similar to those of the catalyst support structure A of the first embodiment of the present invention.

FIG. 13 illustrates the state where a catalyst 60 of a catalyst support structure as a variation of the catalyst support structure C that can be mounted on a support flange 67. The catalyst 60 can be provided with a ring-shaped outer pipe 62 and having an axial length even shorter than that of the outer pipe 52.

The outer pipe 62 can be attached to the axial middle of a carrier 61. A brazing foil 63 can be provided on the entire inner peripheral surface of the outer pipe 62 to join the carrier 61 and the outer pipe 62.

With this structure, less material is needed to form the outer pipe 62 and the brazing foil 63, thereby effecting a lower cost. Additionally, the catalyst 60 also results in essentially the same operation and effect to those of the catalyst support structure C described above.

It is understood that the catalyst support structure according to the present inventions is not limited to the foregoing embodiments but can be practiced with appropriate modifications. For example, in the foregoing embodiments, the catalyst support structure is applied to the exhaust pipe 21 of the water vehicle 10. However, the catalyst support structure of the present inventions can be applied to the exhaust pipe of other watercrafts and to vehicles other than the watercrafts, with or without cooling water passages. It is also understood that the structure, materials and other various parts of the catalyst support structure can be modified in any manner without departing from the scope of the present inventions.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A catalyst device comprising:

an exhaust pipe arranged to be connected to an engine;

a support flange; and a catalyst supported in the exhaust pipe with the support flange, the catalyst being arranged to purify exhaust gas passing through the exhaust pipe, the catalyst including:

a carrier including a flat plate and a corrugated plate layered together, the flat and corrugated plates being rolled up together in a generally columnar shape so that the carrier has a honeycomb structure;

an outer pipe arranged to circumferentially cover a first portion of an outer peripheral surface of the carrier; and a brazing foil arranged to join the first portion of the outer peripheral surface of the carrier and a first portion of an inner peripheral surface of the outer pipe; wherein the catalyst is fixed to the support flange such that an axial direction of the catalyst coincides with a direction in which the exhaust gas flows through the exhaust pipe;

an upstream end of the brazing foil is aligned with an upstream end of the support flange in the axial direction of the catalyst such that no portion of the brazing foil is upstream from the upstream end of the support flange;

the exhaust pipe includes a first exhaust pipe and a second exhaust pipe connected to each other;

each of the first and second exhaust pipes includes an exhaust gas passage through which the exhaust gas passes, and a cooling water passage arranged around the exhaust gas passage;

the support flange includes a cooling water passage slit, the support flange being provided at a connecting portion between the first exhaust pipe and the second exhaust pipe; and the cooling water passage of the first exhaust pipe and the cooling water passage of the second exhaust pipe communicate with each other through the cooling water passage slit.

2. The catalyst device according to claim 1, wherein the brazing foil is arranged between the upstream end of the support flange and a downstream end of the carrier in the axial direction of the catalyst.

3. The catalyst device according to claim 1, wherein an upstream end of the outer pipe is aligned with the upstream end of the support flange in the axial direction of the catalyst.

4. The catalyst device according to claim 1, in combination with a water vehicle, wherein the exhaust pipe is connected to an engine of the water vehicle.

5. The catalyst device according to claim 1, wherein:

the support flange extends radially toward the catalyst and includes a catalyst fixing portion fixed to the catalyst; and the catalyst fixing portion extends only in one axial direction from the support flange.

* * * * *